US011246442B2

(12) United States Patent
Huff et al.

(10) Patent No.: US 11,246,442 B2
(45) Date of Patent: Feb. 15, 2022

(54) BOTTLE HOLDER ASSEMBLY ATTACHABLE TO A TABLE TOP EDGE

(71) Applicants: Scott Larsen Huff, Spanish Fork, UT (US); David K. Kelsch, Herriman, UT (US)

(72) Inventors: Scott Larsen Huff, Spanish Fork, UT (US); David K. Kelsch, Herriman, UT (US)

( * ) Notice: Subject to any disclaimer, the term of this patent is extended or adjusted under 35 U.S.C. 154(b) by 30 days.

(21) Appl. No.: 16/647,520

(22) PCT Filed: May 7, 2018

(86) PCT No.: PCT/US2018/031417
§ 371 (c)(1),
(2) Date: Mar. 15, 2020

(87) PCT Pub. No.: WO2019/055069
PCT Pub. Date: Mar. 21, 2019

(65) Prior Publication Data

US 2020/0268186 A1 Aug. 27, 2020

Related U.S. Application Data

(60) Provisional application No. 62/559,046, filed on Sep. 15, 2017.

(51) Int. Cl.
*A47G 29/08* (2006.01)
*A47G 29/093* (2006.01)
(Continued)

(52) U.S. Cl.
CPC ..... *A47G 29/093* (2013.01); *A47G 23/0225* (2013.01); *A47G 29/087* (2013.01); *D06F 81/00* (2013.01)

(58) Field of Classification Search
CPC ..... A47G 29/00; A47G 29/08; A47G 29/087; A47G 29/093; A47G 29/0225; A47G 23/0225; D06F 81/00; B64D 11/0638; F16M 2200/021; F16M 2200/041; F16M 2200/06
USPC ..... 248/154, 316.1, 316.4, 316.6, 316.7, 248/311.2, 312, 312.1, 313, 309.1, 310, 248/914, 102–106
See application file for complete search history.

(56) References Cited

U.S. PATENT DOCUMENTS 779,453 A * 1/1905 White ..... A61G 5/1043 248/231.85
X920049 4/1909 Good
(Continued)

*Primary Examiner* — Nkeisha Smith
(74) *Attorney, Agent, or Firm* — Angus C. Fox, III

(57) ABSTRACT

A bottle cage is attached to an adjustable clamp that attaches to the edge of the table top of a domestic ironing board. An upper jaw and a lower jaw mechanically engage each other so that they can be squeezed together and immovably lock on the table top edge of an ironing board. One of the jaws (the first jaw) has at least one rack with evenly spaced teeth. The other jaw (the second jaw) has locking teeth, affixed to a resilient upright, which ratchet against the at least one rack as the jaws are squeezed together. The second jaw also incorporates a button on a stalk that protrudes through a slot in the first jaw. A bottle cage incorporates an open-ended slot connector that slides over the button to lock the first jaw to the second jaw. A bottle fits within the bottle cage.

18 Claims, 13 Drawing Sheets

(51) Int. Cl.

| | |
|---|---|
| ***A47G 29/087*** | (2006.01) |
| ***A47G 23/02*** | (2006.01) |
| *D06F 81/00* | (2006.01) |

(56) References Cited

U.S. PATENT DOCUMENTS 1,349,225 A * 8/1920 Rosenblum ..... A41H 15/00 24/527
1,353,853 A * 9/1920 Sandberg ..... A47G 7/044 248/208
1,760,346 A * 5/1930 Correa ..... A47C 21/022 24/72.5
2,796,994 A 6/1957 Saltness
2,926,879 A * 3/1960 Dietrich ..... A47J 45/00 248/311.2
2,955,794 A * 10/1960 Robbins ..... A47H 1/122 248/263
3,376,006 A * 4/1968 Zezula ..... A47G 29/083 248/227.2
3,534,865 A 10/1970 Holliman
3,902,932 A * 9/1975 Gdanski ..... A47K 10/185 248/313
3,913,878 A * 10/1975 Wayne ..... F16M 13/022 248/311.2
4,525,942 A 7/1985 Azzara
4,535,921 A 8/1985 Sanders
4,878,642 A * 11/1989 Kirby, Jr. ..... A47K 1/08 248/311.2
4,887,784 A * 12/1989 Kayali ..... B60N 3/102 248/311.2
5,149,032 A * 9/1992 Jones ..... A47G 23/0225 248/154
5,320,444 A * 6/1994 Bookwaiter ..... B25B 5/163 403/323
5,379,536 A 1/1995 Lorenzana
5,383,793 A * 1/1995 Hsu ..... H05K 7/1405 248/316.4
5,456,437 A * 10/1995 Chander ..... A45B 1/04 211/62
5,472,157 A * 12/1995 Lehrman ..... D06F 79/02 248/311.2
5,706,832 A * 1/1998 Gold ..... A24F 13/22 131/240.1
5,779,206 A * 7/1998 Harris ..... A47B 96/06 248/214
5,822,918 A * 10/1998 Helfman ..... A47H 27/00 47/39
5,842,671 A * 12/1998 Gibbs ..... A47K 1/09 248/231.41
5,853,158 A * 12/1998 Riggle ..... A47G 23/0225 248/311.2
5,996,957 A * 12/1999 Kurtz ..... A47G 23/0225 248/231.21
6,263,597 B1 * 7/2001 Bric ..... D06F 75/28 38/141
6,505,802 B2 * 1/2003 Fowler ..... B60N 3/103 248/230.5
6,550,737 B1 * 4/2003 Sai ..... F16M 13/02 211/69.1
6,601,813 B1 * 8/2003 Kager ..... A45D 20/12 248/314
6,622,980 B2 * 9/2003 Boucher ..... F16B 2/185 248/231.51
6,983,918 B1 * 1/2006 Leasure ..... A63B 55/00 248/311.2
7,156,353 B2 * 1/2007 Kringel ..... A47F 7/283 215/399
7,284,737 B2 * 10/2007 Kane ..... A47G 23/0225 248/226.11
7,793,904 B2 * 9/2010 Scarton ..... A47G 23/0225 248/311.2
8,033,518 B2 * 10/2011 Schuchman ..... B60N 3/103 248/311.2
9,345,353 B2 * 5/2016 Forbes ..... B62B 3/1472
9,944,209 B1 * 4/2018 Carnevali ..... F16M 11/2028
10,258,181 B2 * 4/2019 Chadwick ..... F16B 2/12
10,531,755 B1 * 1/2020 Huang ..... F16B 2/10
10,588,812 B2 * 3/2020 Brockway ..... A61H 1/00
10,981,654 B2 * 4/2021 Slack, Jr. ..... F16M 13/022
2009/0014622 A1 * 1/2009 Merritt ..... A47G 23/0225 248/689
2010/0084531 A1 * 4/2010 Schuchman ..... A47G 23/0225 248/311.2
2010/0096521 A1 * 4/2010 White ..... A47G 23/0225 248/207
2011/0079696 A1 * 4/2011 Hofferber ..... A47G 23/0225 248/313
2012/0181405 A1 * 7/2012 Zlatic ..... F16M 11/041 248/313
2014/0231608 A1 * 8/2014 Fontaine ..... A47G 23/0225 248/311.2
2014/0246550 A1 * 9/2014 Thier ..... A47G 23/0216 248/226.11
2018/0207353 A1 * 7/2018 Hesketh ..... A61M 5/1415

* cited by examiner

FIG. 27
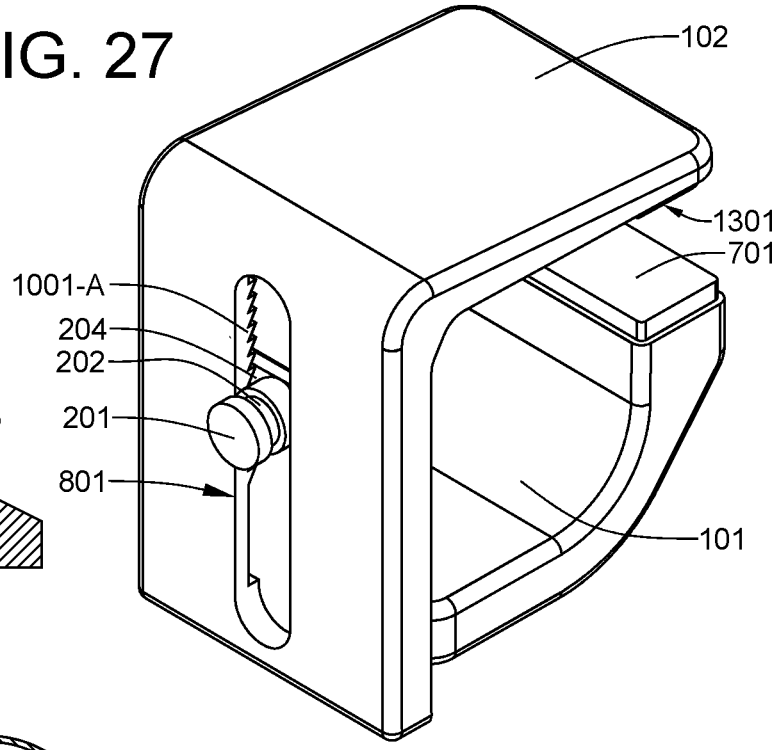
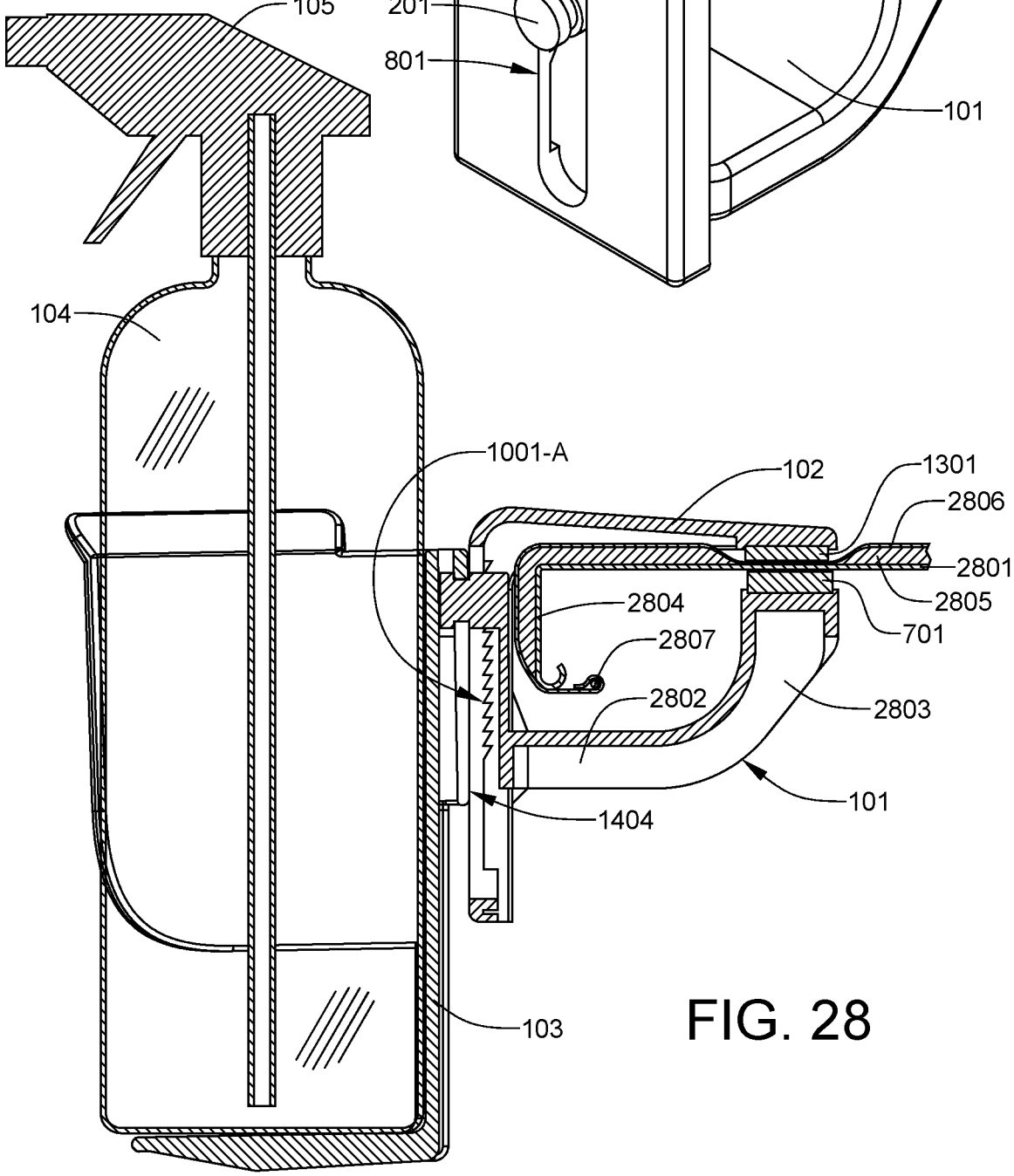
FIG. 28

BOTTLE HOLDER ASSEMBLY ATTACHABLE TO A TABLE TOP EDGE

APPLICATION DATA

This application is a National Stage of PCT/US18/31417 under 35 U.S.C. § 371, that was filed on May 7, 2018, and which has a priority date based on the filling of Provisional Application No. 62/559,046 on Sep. 15, 2017.

FIELD OF THE INVENTION

The present invention relates, generally, to bottle holders and, more particularly, to bottle holders designed to clamp to the edge of a table top. The bottle holder of the present invention is disclosed in the context of a bottle holder attachable to the table top edge of an ironing board, but can be used with other types of tables and bottles.

BACKGROUND OF THE INVENTION

Ironing is the use of a heated tool (an iron) to remove wrinkles from fabric. The heating is commonly done to a temperature of 180-220° Celsius, depending on the fabric. Ironing works by loosening the bonds between the long-chain polymer molecules in the fibers of the material. When the fabric is heated, the molecules are more easily reoriented. While the molecules are hot, the fibers are straightened by the weight of the iron, and they hold their new shape as they cool. In the case of cotton fibers, which are derivatives of cellulose, the hydroxyl groups that crosslink the cellulose polymer chains are reformed at high temperatures, and become somewhat "locked in place" upon cooling the item. The use of steam, particularly during the ironing of cotton, facilitates the loosening of the intermolecular bonds. Many modern fabrics (developed in or after the mid-twentieth century) are advertised as needing little or no ironing. Permanent press clothing was developed to reduce the ironing necessary by combining wrinkle-resistant polyester with cotton. In permanent-press clothing, chemical agents such as dimethylol ethylene urea are typically added as crosslinking agents.

The iron is the small appliance used to remove wrinkles from fabric. It is also known as a clothes iron, flat iron, or smoothing iron. The piece at the bottom is called a sole plate. Ironing uses heat energy, chemical energy, electrical energy, and mechanical energy. The first known use of heated metal to "iron" clothes is known to have occurred in China. The electric iron was invented in 1882, by Henry W. Seeley. Seeley patented his "electric flatiron" on Jun. 6, 1882 (U.S. Pat. No. 259,054).

Most ironing is done on an ironing board, which is a small, portable, foldable table with a heat-resistant surface. Some commercial-grade ironing boards incorporate a heating element and a pedal-operated vacuum to pull air through the board and dry the garment. On 15 Feb. 1858 W. Vandenburg and J. Harvey patented an ironing table that facilitated pressing sleeves and pant legs. A truly portable folding ironing board was first patented in Canada in 1875 by John B. Porter. The invention also included a removable press board used for sleeves. In 1892 Sarah Boone obtained a patent in the United States for improvements to the ironing board, allowing for better quality ironing for shirt sleeves.

Although early ironing tables likely used a wood board for the ironing surface, the ironing surface of modern domestic ironing boards is typically stamped from a single piece of thin steel sheet metal that is downwardly crimped on the edges to form a perimetric rim that strengthens and stiffens the surface. In addition, longitudinal and lateral stiffeners are spot welded to the underside of the ironing surface. A support frame, generally consisting of a pair of X-folding legs, is typically attached to the under-surface stiffeners of the table top. The legs are typically designed so that they fold nearly parallel and against the under side of the table top so that the entire ironing board may be easily stored in an upright position in a closet with the table top disposed vertically. Although ironing boards come in a variety of sizes, a standard domestic ironing table has a table top that is typically a narrow, generally rectangular member with a tapered nose, and having a length of about 137 centimeters and a width of about 36 centimeters. From the foregoing description, it is obvious that the term "ironing board" is somewhat misdescriptive. Further complication arises because, in general usage, the term ironing board is typically considered to be an apparatus which includes a set of foldable legs. Thus, in order to be precise, the planar component of the ironing board on which clothing articles are ironed will be referred to as, simply, a table top.

The present invention relates generally to domestic clothes pressing or ironing and, more specifically, to an attachment to be used on a domestic ironing board to support in a convenient location a spray bottle used in the ironing of clothes. It is desirable for one performing the clothes pressing task to have such items as distilled water and spray starch conveniently available so that they may be applied to the clothes or the electric iron without requiring the party to move away from the ironing board. It is important that these items not be positioned on the ironing board where they would be an obstruction to the positioning of clothes on the ironing board.

Given that a considerable amount of effort and design has gone into producing an ironing board design that is compact and easily stored when the legs are folded against the table top, it is important that any attachment for an ironing board also be very compact not interfere with its vertical storage in a small space.

The supplies that are most commonly required during the ironing of clothes are starch and distilled water. It is preferable that both be close at hand while a piece of clothing is being ironed. Starch is available in spray containers and is applied to clothes to make them stiffer so that they retain ironed folds, creases and pleats. Distilled water is typically sprayed on an article of clothing while it is being ironed in order to better remove wrinkles and creases that are the result of the washing and drying process. Alternatively, an electric steam iron is filled with distilled water so that steam can be automatically generated during the ironing process.

There are patents which disclose various types of ironing board attachments, some of which are intended to support spray starch containers positioned conveniently with respect to an ironing board. Included in these patents are the Sanders U.S. Pat. No. 4,535,921 and the Azzara U.S. Pat. No. 4,525,942. The patent to Sanders discloses a small, upright container having a spring clip to secure it to the downwardly extending side wall of the table top; the container is of appropriate size to receive a starch container. The patent to Azzara discloses a basket which is adapted to receive a can containing spray starch. The basket is attached to the end of the ironing board by a bracket which lays across a rail that is secured to the board by brackets and a spring.

U.S. Pat. No. 3,913,878 to Flora Wayne discloses an ironing board attachment designed to clamp to the nose of the table top of an ironing board by means of one or more finger operated screws. The attachment includes a basket adapted to receive a starch can. The Wayne application recognizes the problem of providing an attachment which does not interfere with the storing of the ironing board by increasing its bulk. The Wayne application solves this problem by having the starch supporting basket separable from the structure for clamping the attachment to the ironing board.

U.S. Pat. No. 3,534,865 to Holliman and U.S. Pat. No. 2,796,994 to Saltness are of interest as showing ironing board attachments which are readily detachable from mounted positions on ironing boards. Both of these patents relate to garment supports which have clamping members spring biased into engagement with the opposite edges of a table top of an ironing board. U.S. Pat. No. 920,049 to Good discloses an ironing board attachment which is detachably secured to the upper surface of the table top by telescoping U-shaped members which engage the opposite edges of the table top. None of the above cited items of art disclose a structurally simple ironing board attachment for supporting a spray bottle containing either starch or water, which is easily detachable from the ironing board, and which provides minimum obstruction to the clothes pressing operation.

U.S. Pat. No. 5,379,536 to Moises B. Lorenzana discloses a wire basket for holding a starch-containing spray bottle and a water bottle that is readily attachable to the square end of the table top of a domestic ironing board. The basket is supported by a yoke, which fits over the edges of the table top and is pivotally attached to basket.

SUMMARY OF THE INVENTION

The present invention provides a bottle holder that attaches to an adjustable clamp that attaches to the edge of the table top of a domestic ironing board. The bottle holder is pivotally attached to the adjustable clamp so that the bottle holder and a contained bottle can remain upright when the ironing board is folded and placed in a vertical or nearly vertical orientation, such as leaning against a wall. Although the bottle holder was designed specifically for attachment to an ironing board, it can also be attached to the edge of most any table or shelf as long as the table or shelf doesn't have a border that is wider than the clamp is designed to accommodate.

A preferred embodiment of the adjustable clamp is fabricated from three structural components that are injection molded from a structural thermoplastic, such as acrylonitrile butadiene styrene (ABS), polycarbonate (PC), or a fiber-reinforced plastic, such as glass or carbon fiber reinforced epoxy or polyester resin, and a pair of resilient pads. The first component is an upper jaw having an inverted, generally L-shaped elevational side profile. The vertical portion of the upper jaw is equipped with a pair of spaced-apart vertical channels of C-shaped cross section, a central vertically-oriented slot, and a gear rack with upwardly-ramped teeth positioned between the slot and each vertical channel. A first resilient pad is mounted on a lower surface of the horizontal portion of the upper jaw. The second component is a lower jaw having a generally reclinate J-shaped elevational side profile. Attached to the top of the J are a pair of spaced-apart pi-beam (in profile, it looks like the symbol for the ratio of circumference to the diameter of a circle) sliders that engage and slide into the channels of the upper jaw. A second resilient pad is mounted on an upward-facing surface at the bottom end of the J. A lower end of a resilient upright panel is attached to the top of the J between the pi-beam sliders, while an upper end of the panel is equipped with a horizontally-disposed button on a stalk and at least one locking tooth on each side of the button that has a profile identical to that of teeth on the rack of the upper jaw, but flipped 180 degrees so that they face and engages the teeth of the racks. The button projects through the slot on the upper jaw when the pi-beam sliders have slid into the channels of the upper jaw. Once the pi-beam sliders of the lower jaw have been slid into the channels of the upper jaw, the assembly consisting of both jaws can be placed around the table top edge of a conventional stamped sheet metal ironing board and the jaws can be squeezed together until they are immovably locked onto the ironing board. The bottle cage, which is the third component of the assembly, has an open slot that slides and snaps over the button, thereby preventing release of the locking teeth from the racks and locking the lower jaw to the upper jaw until the bottle cage is removed from the jaw assembly and the button is pushed to disengage the locking teeth from the racks.

Although it should be clear that the role of the upper and lower jaws can be reversed, the present embodiment of the invention provides a more elegant design, as the channels are downward facing, rather than upward facing, where they would, more likely, be visible.

BRIEF DESCRIPTION OF THE DRAWINGS

While the present invention is described with particularity in the claims, which are annexed hereto and form a part of this specification, a better understanding of the invention can be had by reference to the following detailed thereof, taken in conjunction with the accompanying drawings in which:

FIG. 27 is an isometric view of the upper jaw and lower jaw components, in a configuration of locked engagement; and FIG. 28 is a cross-sectional view of the bottle holder assembly and an installed transparent bottle incorporating a spray head and drop tube, taken through a vertical center section plane extending front to rear.

DESCRIPTION OF THE PREFERRED EMBODIMENT

Figure 1:
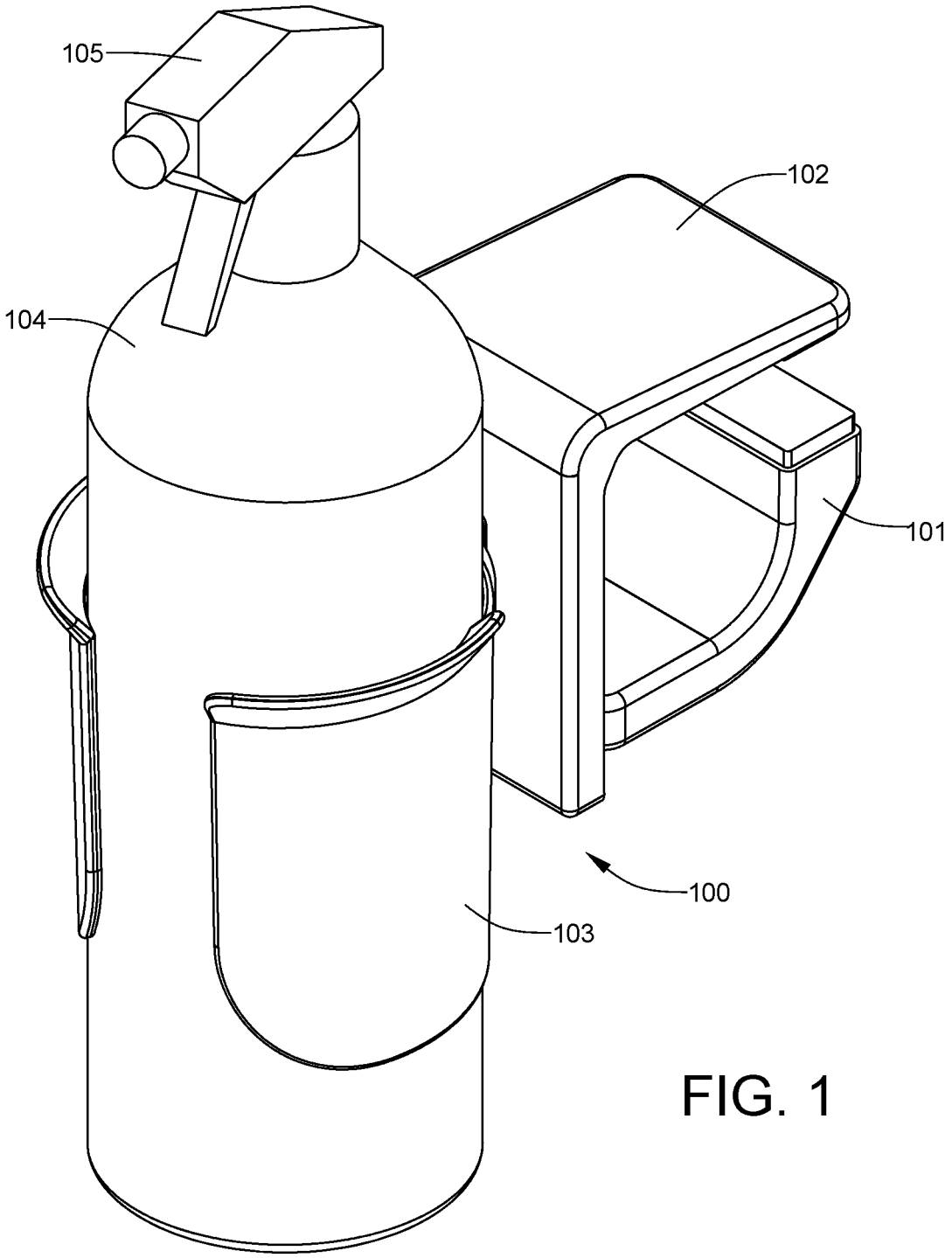
FIG. 1 is an isometric view of the bottle holder, in which has been installed a generic spray bottle.
Figure 2:
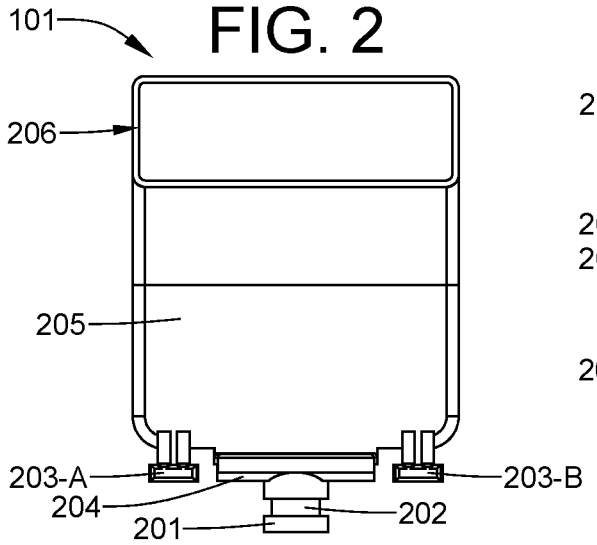
FIG. 2 is a top plan view of the lower jaw.
Figure 3:
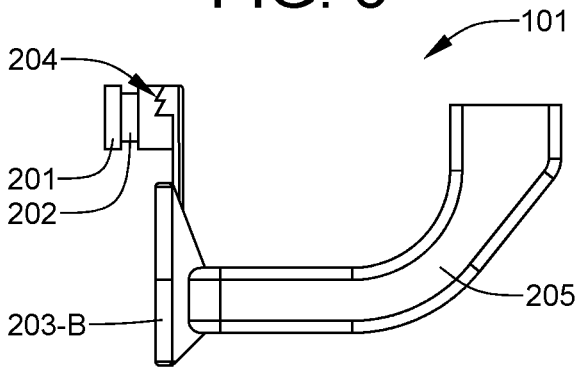
FIG. 3 is a right side elevational view of the lower jaw.
Figure 4:
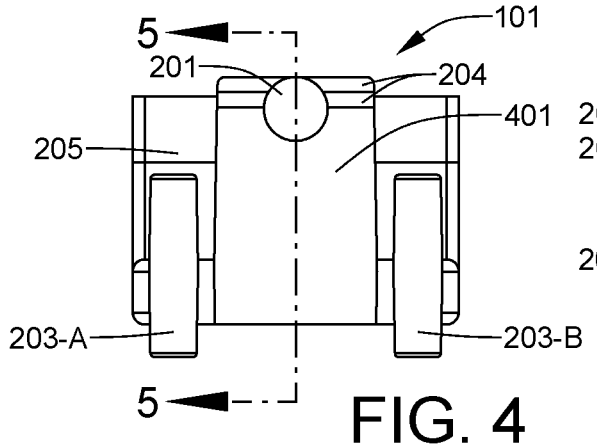
FIG. 4 is a front elevational view of the lower jaw.
Figure 5:
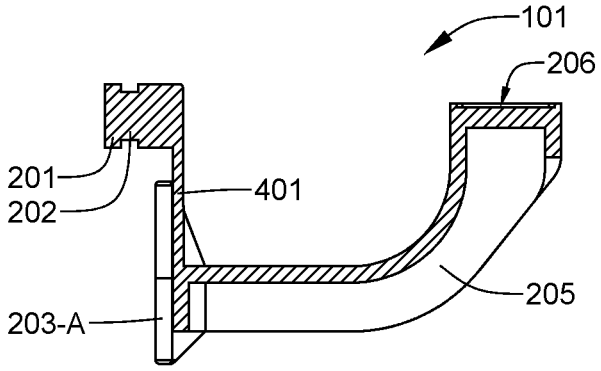
FIG. 5 is a cross-sectional view of the lower jaw, taken through vertical center section plane 5-5 of FIG. 4.
Figure 6:
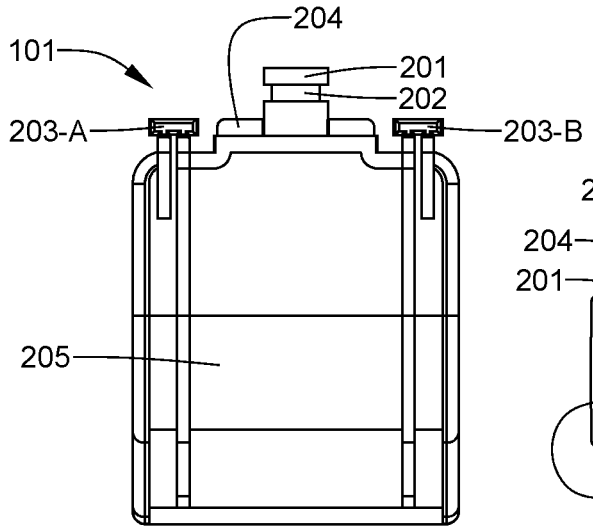
FIG. 6 is a bottom plan view of the lower jaw.
Figure 7:
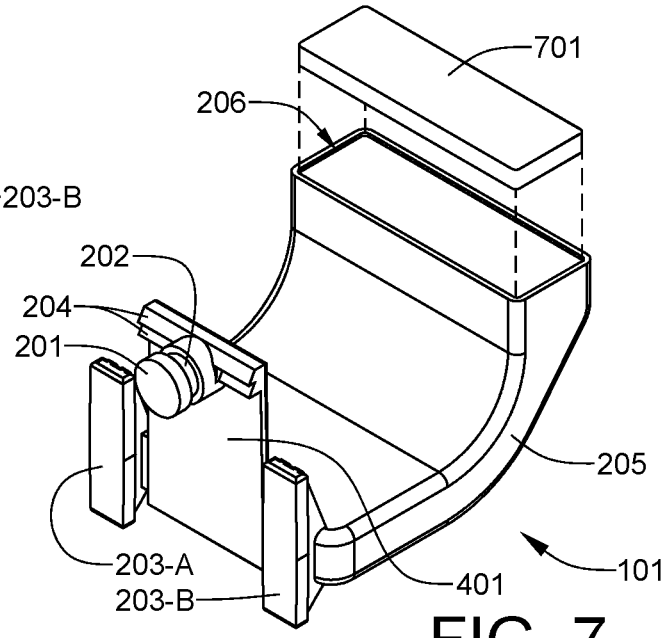
FIG. 7 is an isometric view of the lower jaw and of a resilient pad which will be adhesively installed within the pad recess of the lower jaw, taken from a upper right front vantage point.
Figure 8:
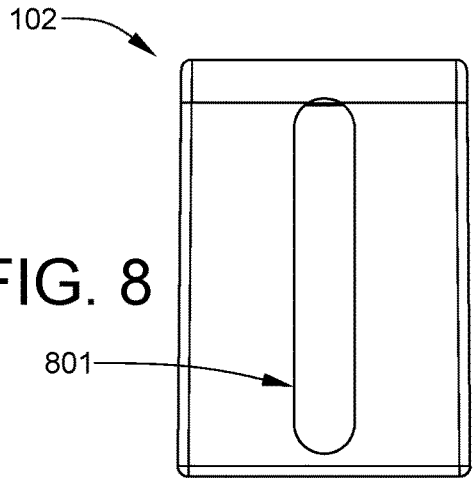
FIG. 8 is a front elevational view of the upper jaw.
Figure 9:
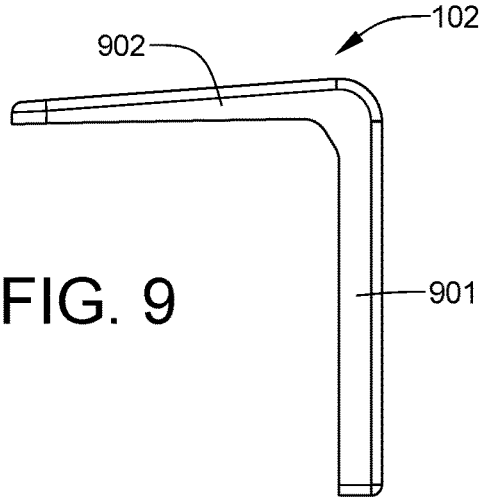
FIG. 9 is a right side elevational view of the upper jaw.
Figure 10:
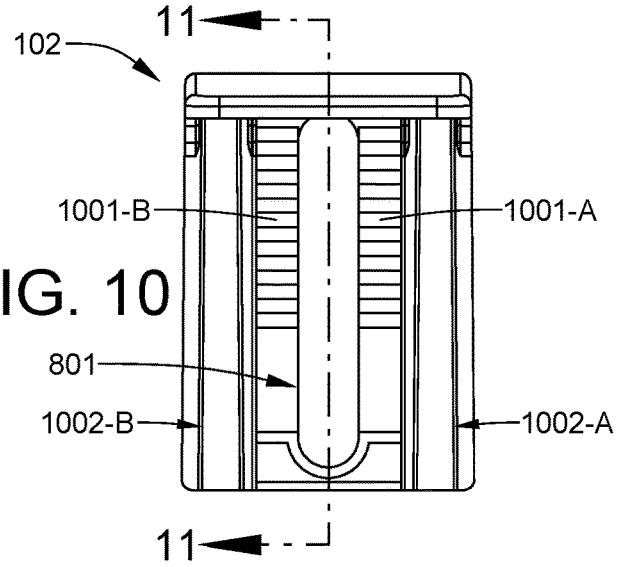
FIG. 10 is rear elevational view of the upper jaw.
Figure 11:
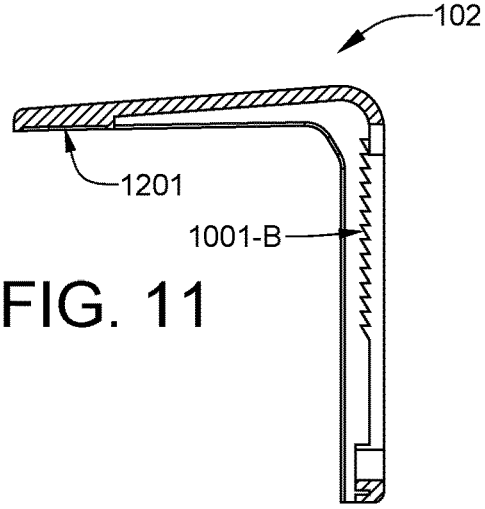
FIG. 11 is a cross-sectional view of the upper jaw, taken through vertical center section plane 11-11 of FIG. 10.
Figure 12:
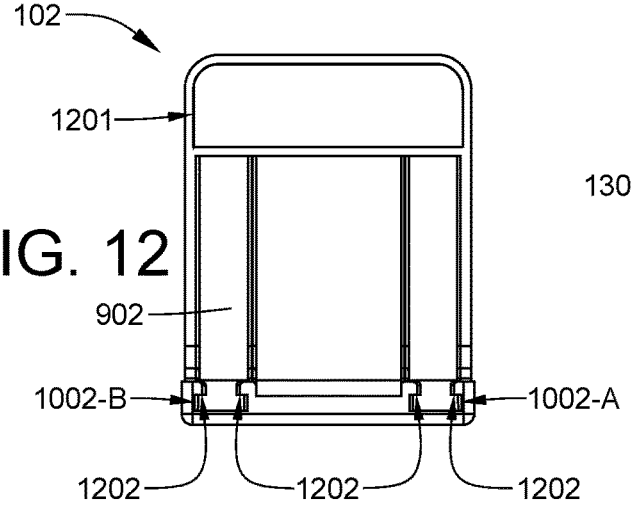
FIG. 12 is a bottom plan view of the upper jaw.
Figure 13:
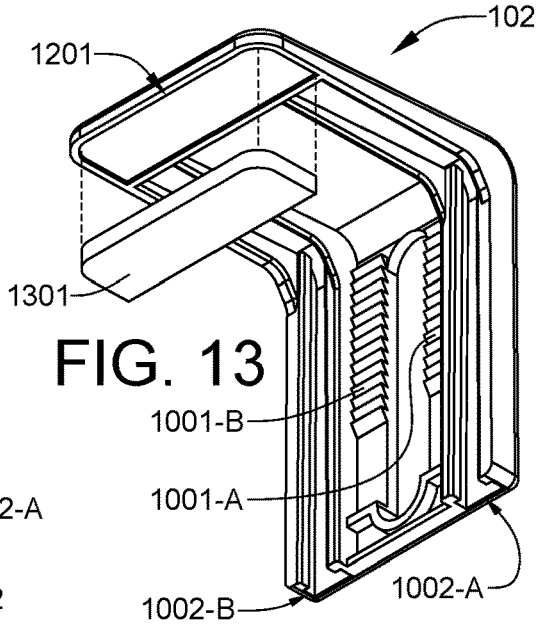
FIG. 13 is an isometric view of the upper jaw and of a resilient pad which will be adhesively installed within the pad recess of the upper jaw, taken from a lower left rear vantage point.
Figure 14:
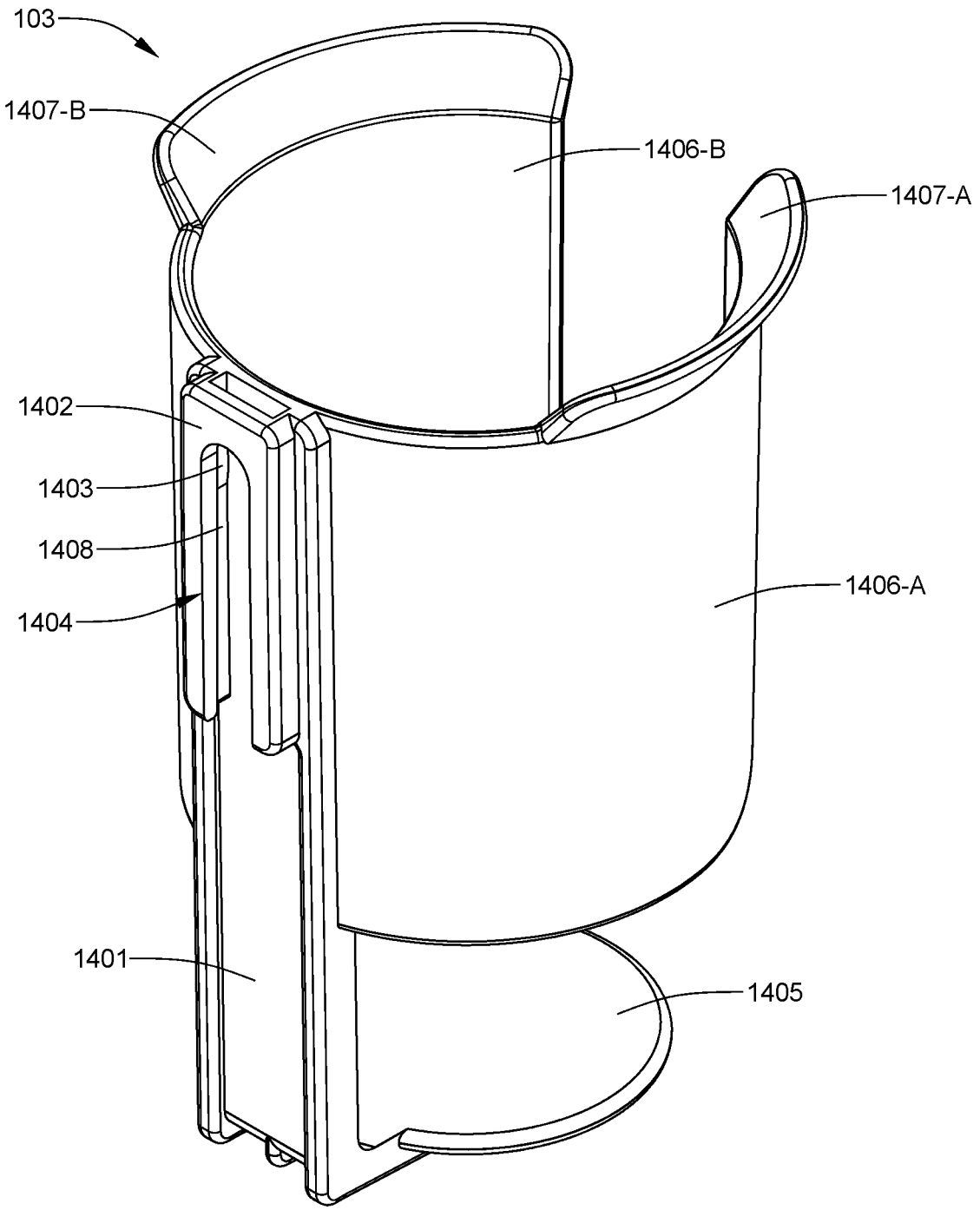
FIG. 14 is an isometric view of the bottle cage, taken from a upper left rear vantage point.
Figure 15:
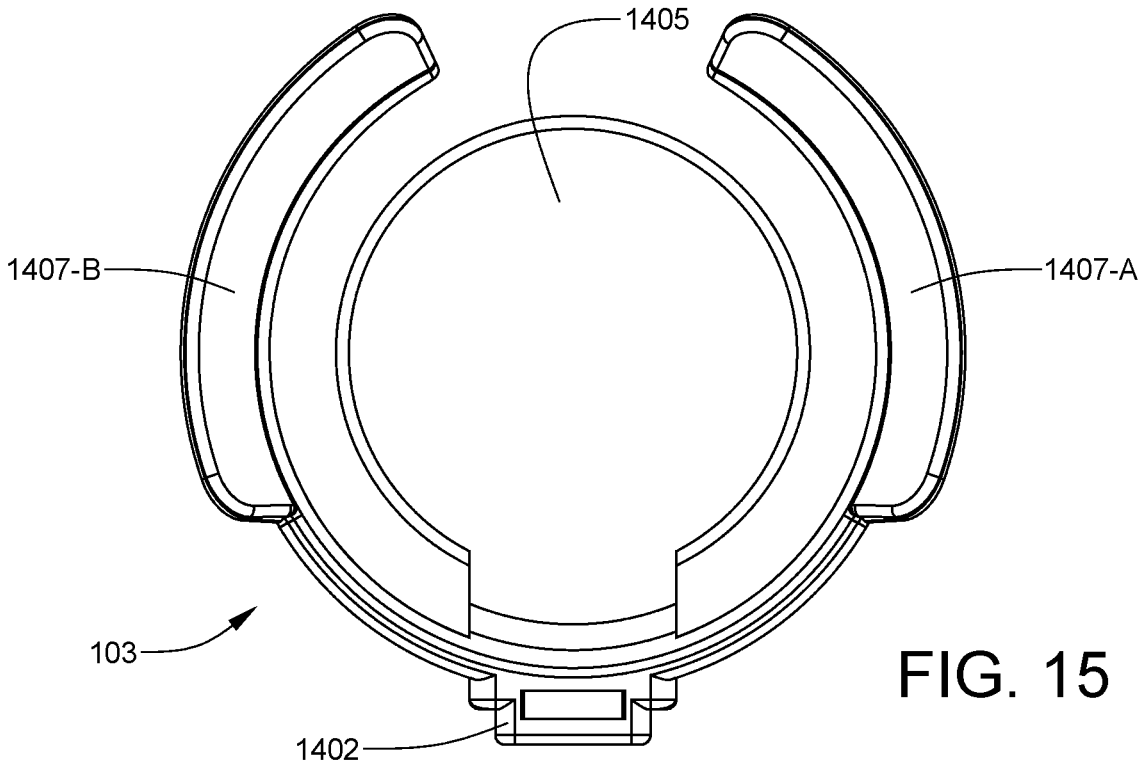
FIG. 15 is a top plan view of the bottle cage.
Figure 16:
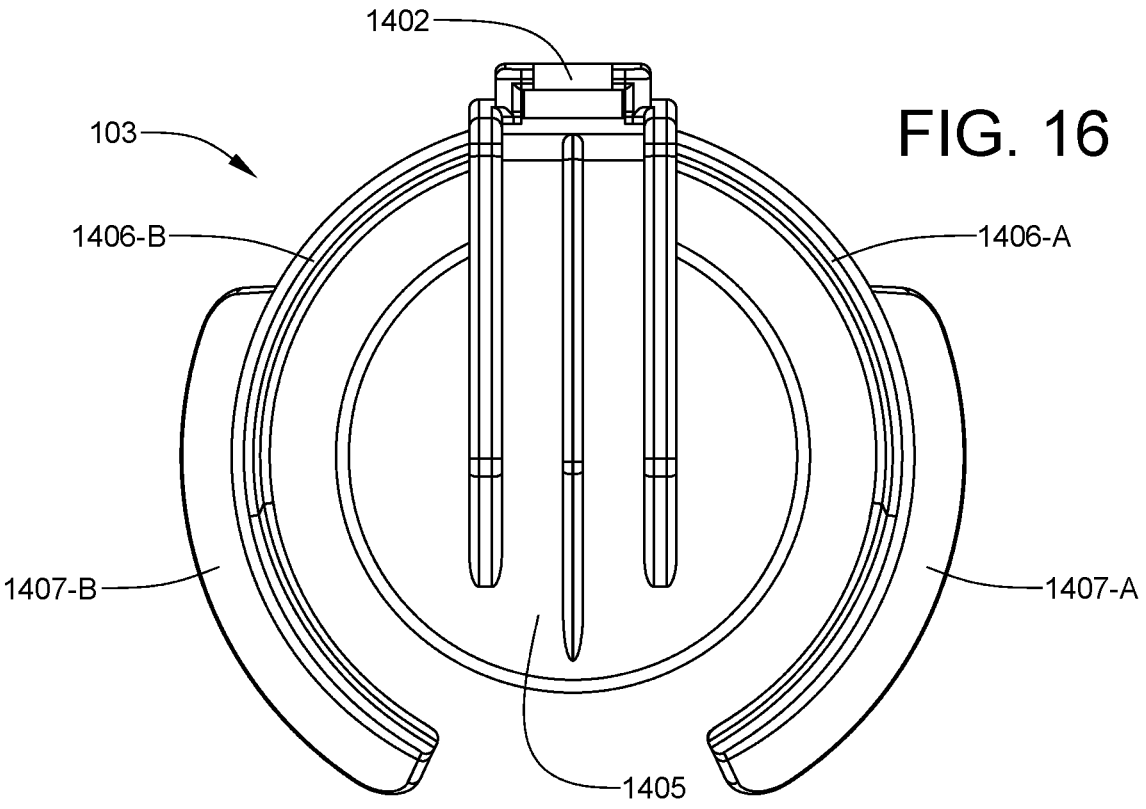
FIG. 16 is a bottom plan view of the bottle cage.
Figure 17:
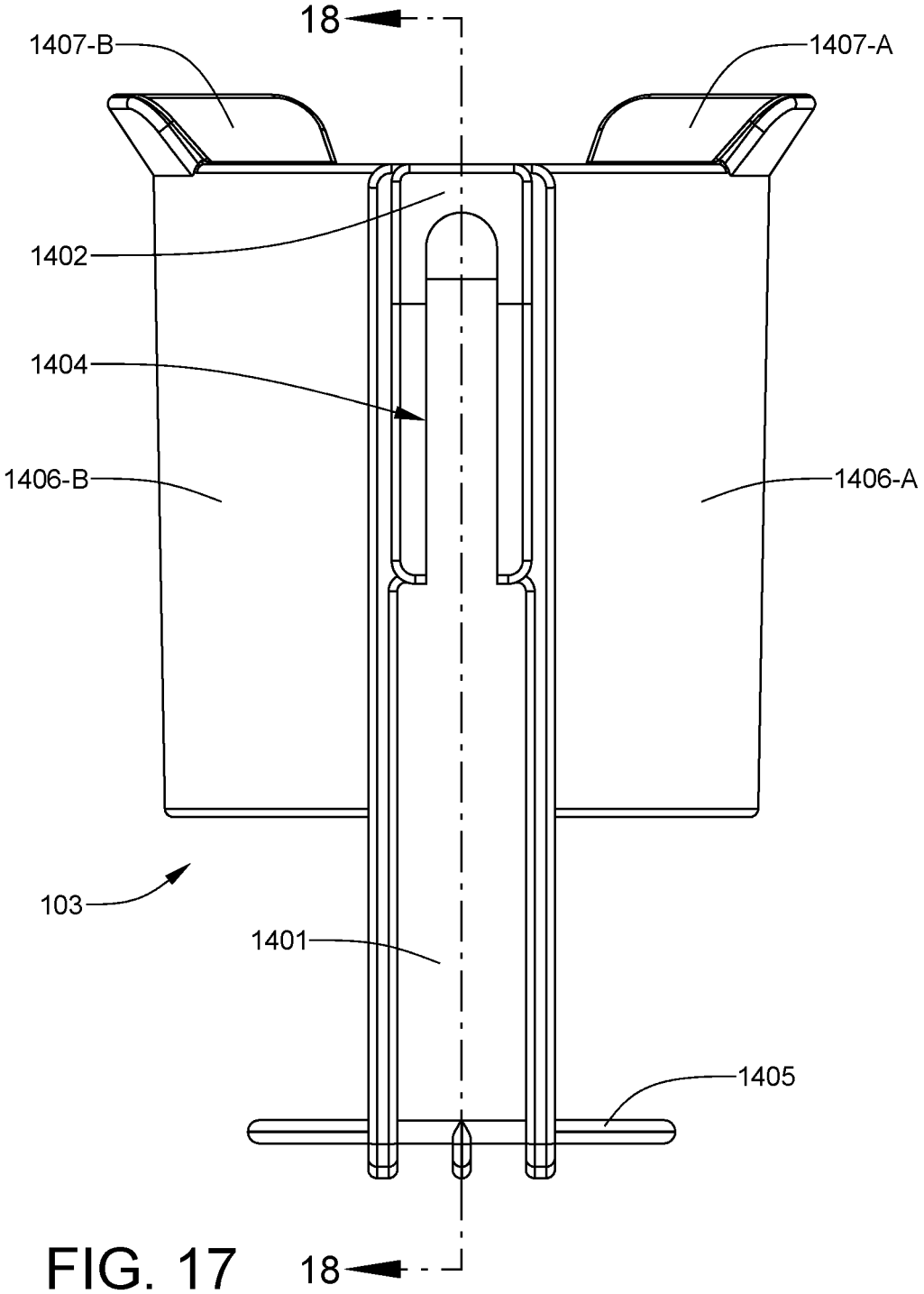
FIG. 17 is a rear elevational view of the bottle cage.
Figure 18:
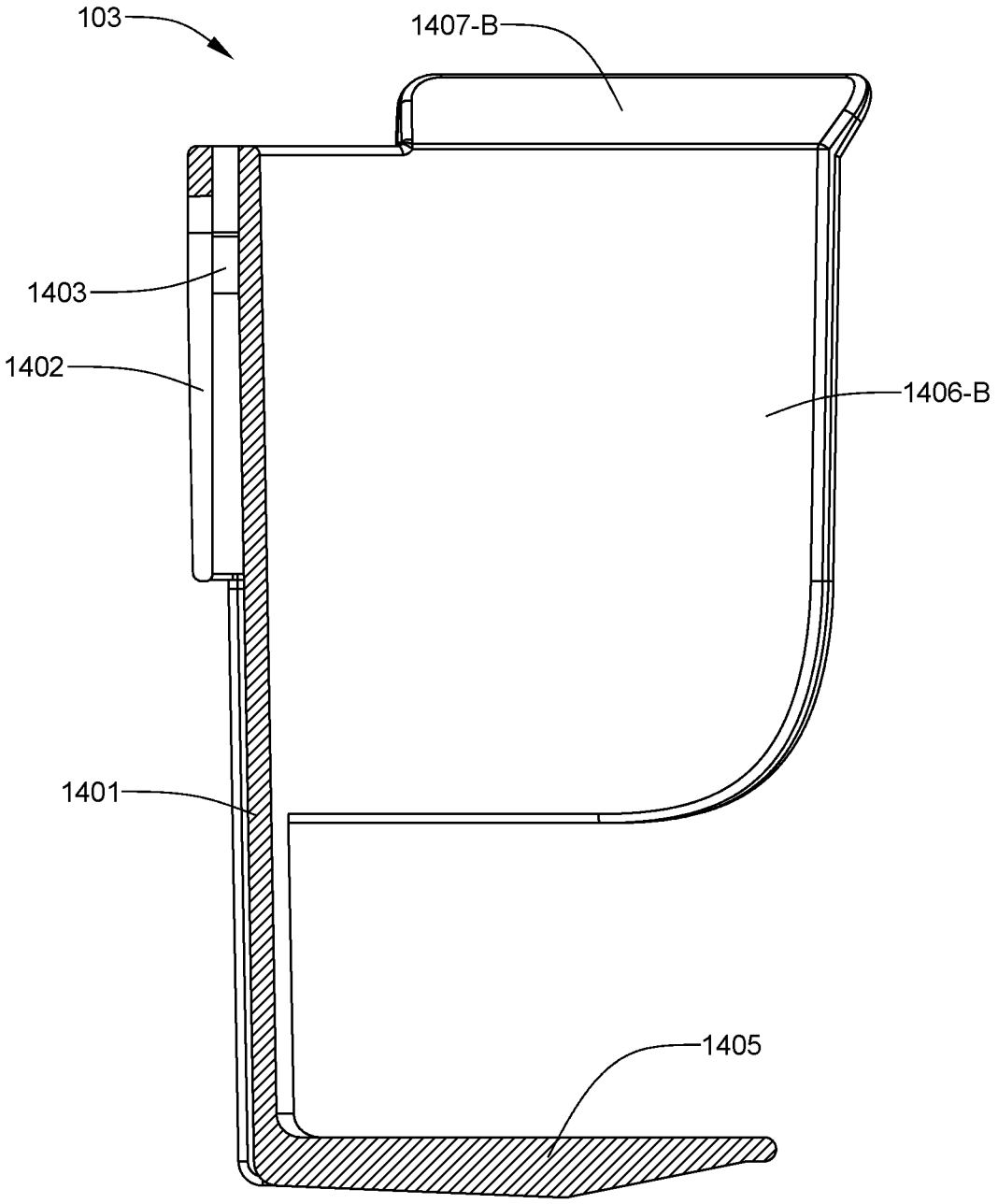
FIG. 18 is a cross-sectional view of the bottle cage, taken through the vertical center section plane 18-18 of FIG. 17.
Figure 19:
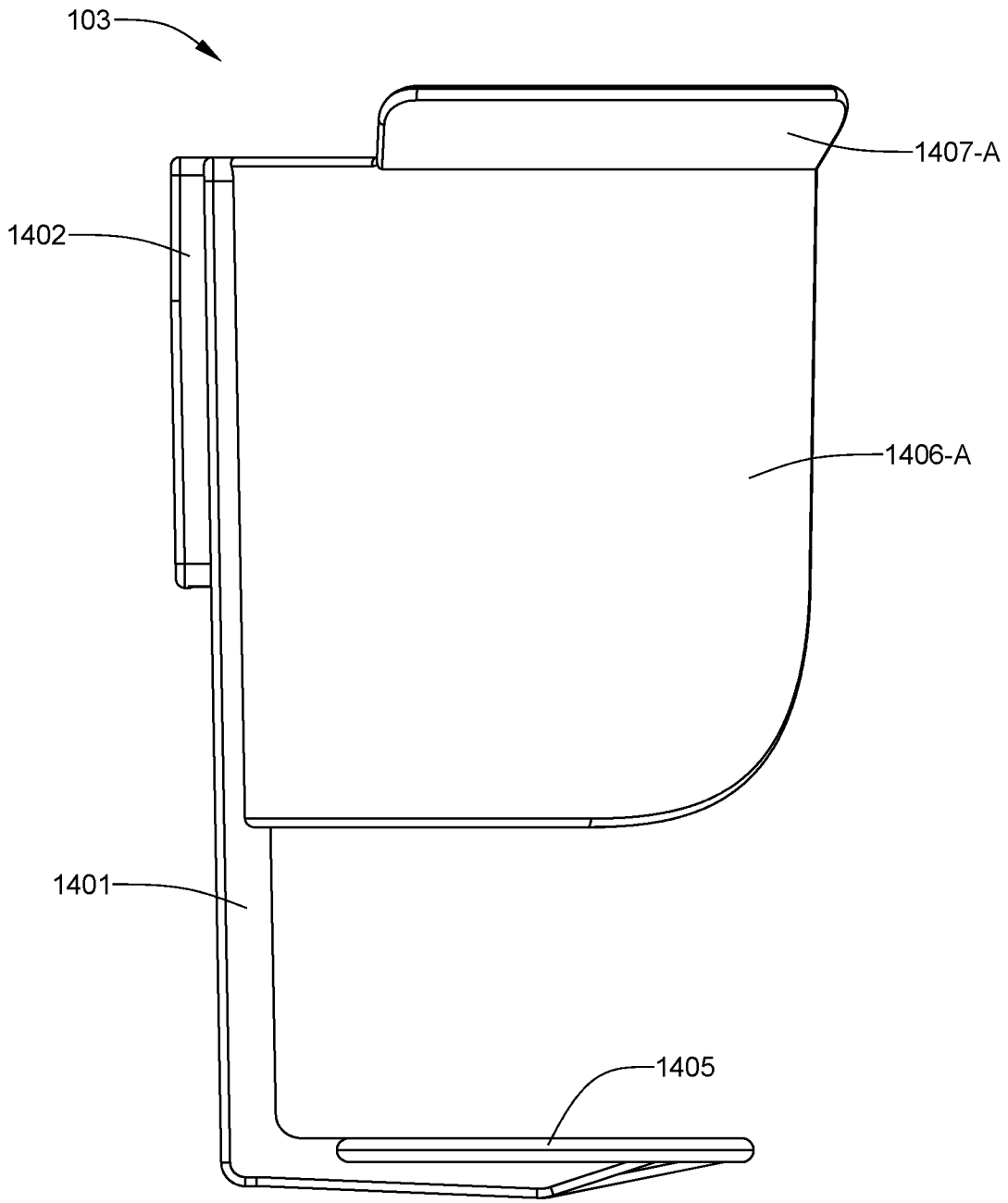
FIG. 19 is a left side elevational view of the bottle cage.

The bottle holder assembly will now be described in detail, with reference to the attached drawing figures. Element numbers comprise three or four digits. The left-most digit of three-digit element numbers and the two left-most digits of four-digit elements numbers indicate the drawing figure number where the element is first most clearly visible.

Referring now to FIG. 1, a bottle holder assembly 100 is shown that is attachable about the perimeter of the table top of a domestic ironing board. Typically, the pressing "board" is formed from a planar expanse of sheet metal that is downwardly crimped on the edges to form a perimetric rim that stiffens the pressing board. The bottle holder assembly 100 comprises three components: a two component adjustable clamp and a bottle cage. The clamp that includes a lower jaw 101 and an upper jaw 102. The jaws 101 and 102 are designed such that they fit together so that the lower jaw 101 and the upper jaw 102 can be positioned around the table top edge of an ironing board, and squeezed together so that they press against the upper and lower surfaces of the table top, or pressing board. The bottle cage 103, in which has been inserted a bottle 104 having a spray head 105, has a connector with an open-ended slot that slides over a button on the lower jaw 101 that protrudes through a slot in the upper jaw 102. Not only does this connection of the bottle cage 103 to the lower jaw 101 enable the bottle cage 103 to pivot so that the bottle cage and a contained bottle can remain upright when the ironing board is folded and placed in a vertical or nearly orientation, such as leaning against a wall, it also locks the upper and lower jaws together so that they are immovably clamped against the upper and lower surfaces of the ironing board table top. These details will be subsequently shown and described in more detail. The bottle holder assembly 100 will be described with respect to a particular orientation. The bottle cage 103 will be considered the front of the bottle holder assembly 100, while the adjustable clamp, which comprises lower jaw 101 and upper jaw 102, will be considered the rear of the assembly.

Referring now to FIGS. 2 through 7, the lower jaw 101 of the adjustable clamp has a reclinate J-shaped body 205, a pair of spaced-apart pi-beam sliders 203-A and 203-B which are integral with the top of the reclinate J-shaped body 205, and a resilient upright panel 401 having a lower end integral with the top (front side of the lower jaw 101) of the reclinate J-shaped body 205. The upper end of the upright panel 401 is equipped with a front-protruding button 201 that is attached to the upright panel 401 via a stalk 202. On each side of the button 201 is a pair of locking teeth 204. An upper resilient 701 will be adhesively bonded to a recess 206 at the bottom end of reclinate J-shaped body 205.

Referring now to FIGS. 8 through 13, the upper jaw 102 has a generally inverted L-shaped side profile made up of a vertical portion 901 and a horizontal portion 902. The vertical portion 901 has a central slot 801 that is closed at both ends. The rear-facing side of the vertical portion 901 is equipped with is equipped with a pair of spaced-apart vertical channels 1002-A and 1002-B of block-C-shaped cross section, positioned on opposite sides of the central slot 801, and a gear rack with upwardly-ramped teeth positioned between the slot 801 and each vertical channel 1001-A and 1001-B. Because of its block-C-shaped cross section, each vertical channel 1002-A and 1002-B has two overhanging edges 1202 that trap the pi-beam sliders 201-A. A lower resilient pad 1301 will be adhesively bonded to a recess 1201 in the horizontal portion 902.

Referring now to FIGS. 14 through 19, the bottle cage 103 has a vertical spine 1401, a left semi-cylindrical cage 1406-A and a right semi-cylindrical cage 1406-B attached to the spine 1401, a foot 1405 attached to the base of the spine 1401, a left flared guide 1407-A integral with the left semi-cylindrical cage 1406-A, a right flared guide 1407-B integral with the right semi-cylindrical cage 1406-B, and a connector 1402 having a slot 1404 open at the bottom end there of attached to an upper-most portion of the spine 1401. Raised speed bumps 1403 near the top of an inner track 1408 on each side of the slot 1404 lock the button 201 in place when it is slid to the top of the slot 1404.

Figure 20:
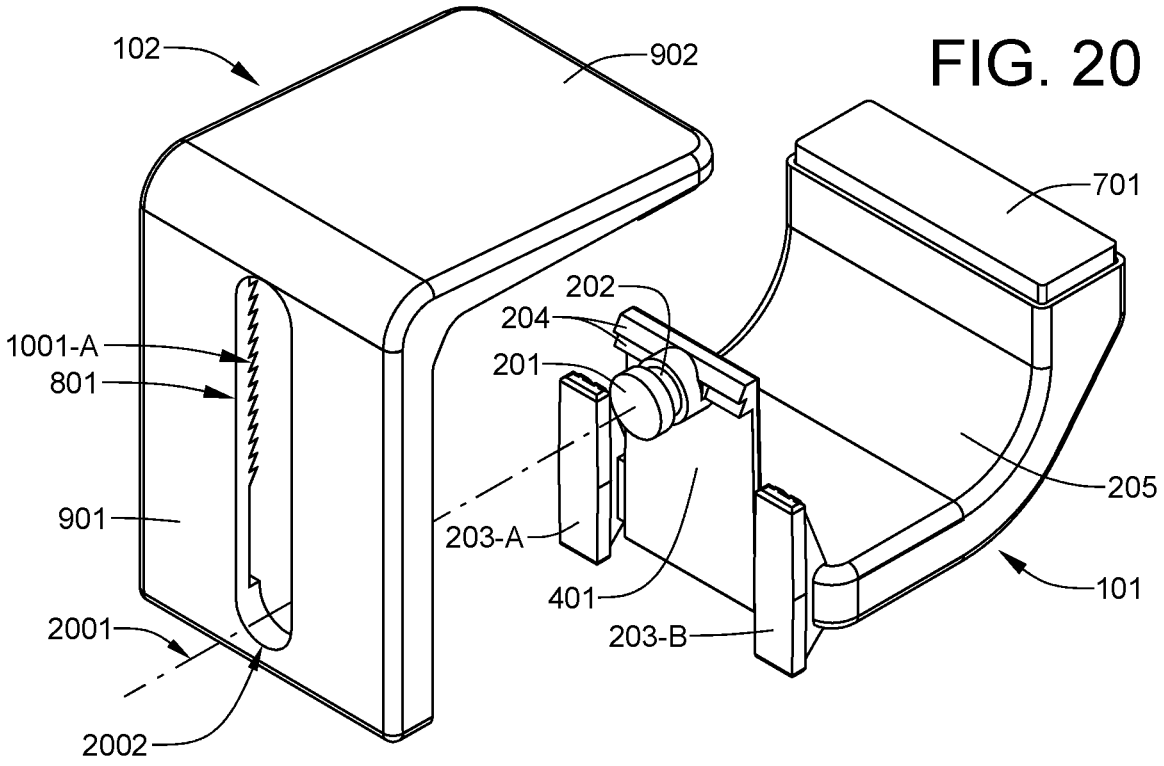
FIG. 20 is an isometric view of the upper jaw and the lower jaw components, aligned for initial engagement, taken from an upper right front vantage point.

Referring now to FIG. 20, the upper jaw 102 and the lower jaw 101 are aligned for initial engagement. A centerline 2001, which passes through the axis of the button 201 and stalk 202, as well as through the axis of the arc 2002 at the bottom of the slot 801, shows the alignment required for the upper jaw 102 and the lower jaw 101 to be assembled as a unit.

Figure 21:
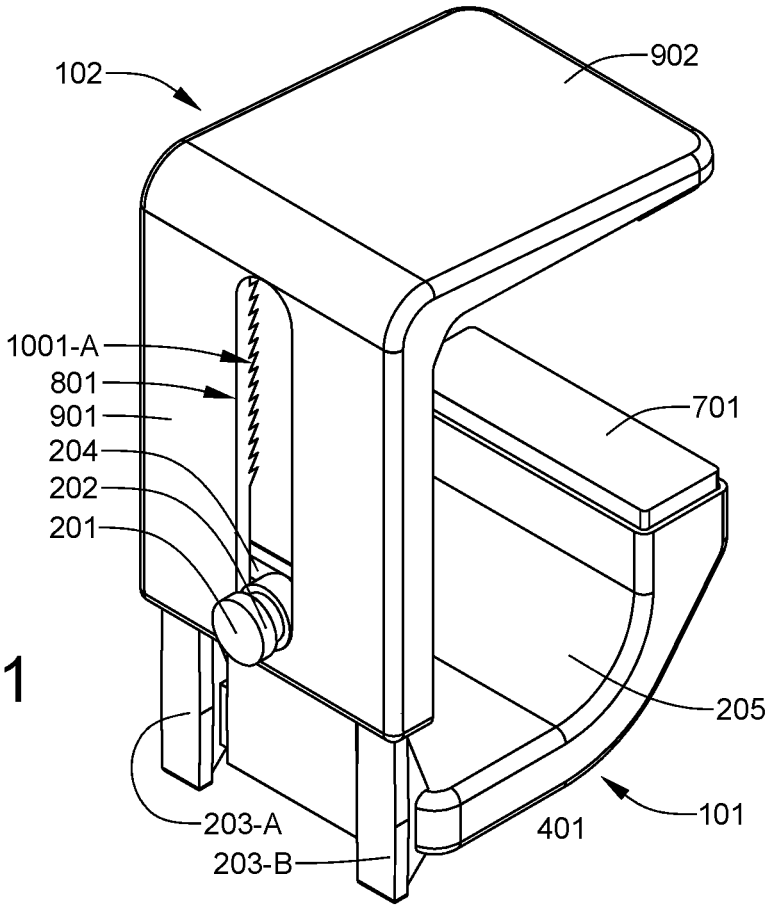
FIG. 21 is an isometric view of the upper jaw and the lower jaw components, in a configuration of initial engagement, taken from an upper right front vantage point.

Referring now to FIG. 21, the lower jaw 101 has been moved toward the upper jaw 102 along the centerline 1001 (see FIG. 20) until the button 201 and stalk 202 protrude through the slot 801. As configured in this figure, the pi-beam sliders 203-A and 203-B and aligned for entry into the spaced-apart vertical channels 1002-A and 1002-B of the upper jaw 102. As the pi-beam sliders 203-A and 203-B slide up the spaced-apart vertical channels 1002-A and 1002-B, the locking teeth 204 on the resilient vertical panel 401 slide up the rear side of the vertical portion 901 of the upper jaw 102 and, with about 2 cm of upward travel, begin to make ratcheting engagement with the vertical racks 1001-A and 1001-B. As they are injection molded from structural thermoplastic resin, there is some resiliency in the upper and lower jaws, 102 and 101, respectively. Thus, when they are squeezed together against the upper and lower surfaces of a table top, they deform slightly to provide a force loading of the locking teeth 204 against the teeth of the vertical racks 1001-A and 1001-B.

Figure 22:
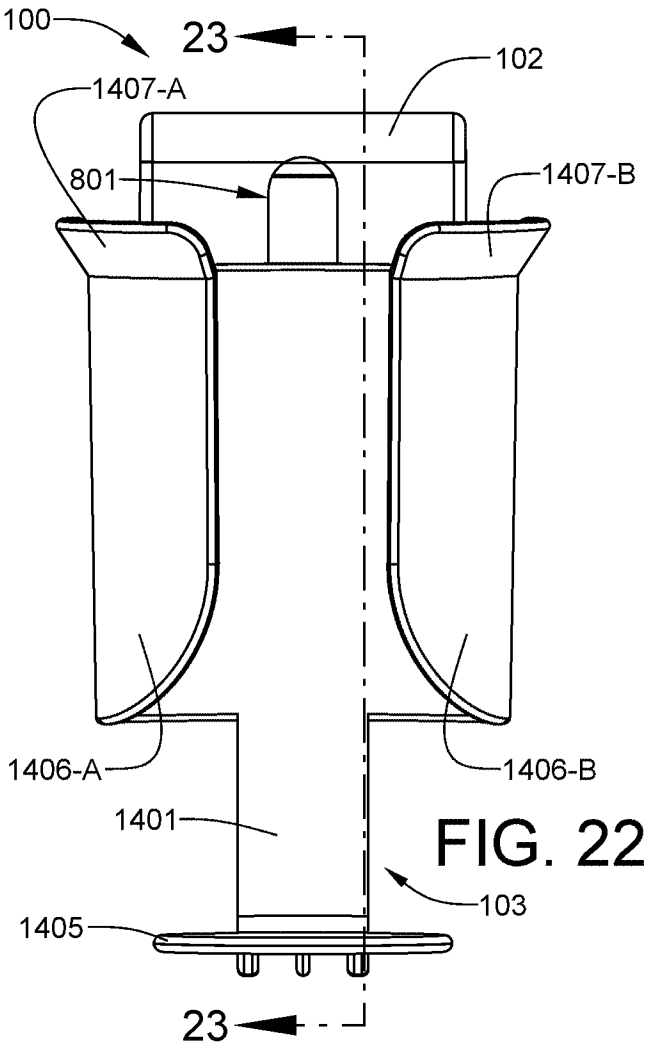
FIG. 22 is a front elevational view of the bottle holder assembly.

Referring now to FIG. 22, the bottle holder assembly 100 is shown in a frontal view. The bottle cage 103 has been attached to the button 201 and stalk 202. The upper jaw 102 is visible in the background, as is the upper portion of the slot 801.

Figure 23:
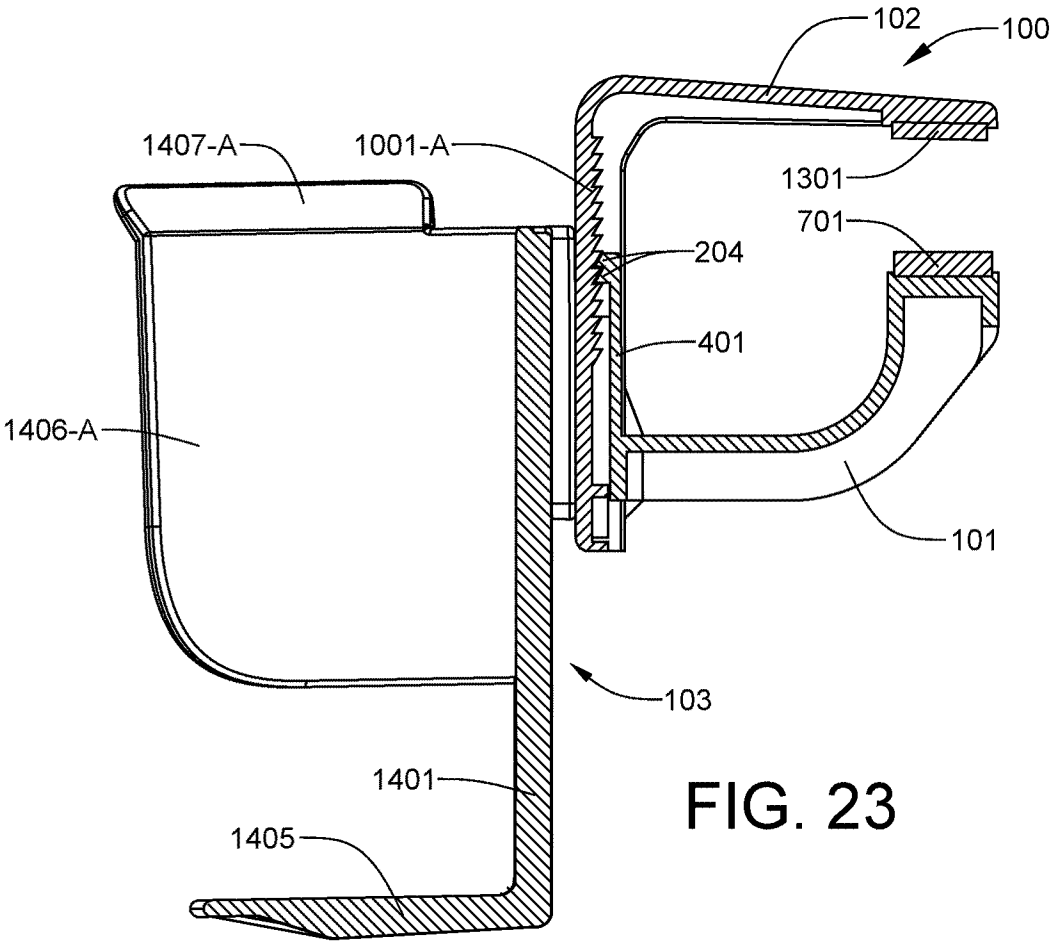
FIG. 23 is a cross-sectional view of the bottle holder assembly, taken through vertical section plane 23-23 of FIG. 22.

Referring now to FIG. 23, this off-center cross-section view of the bottle holder assembly 100 shows the engagement of the locking teeth 204, located on the resilient vertical panel 401, with teeth of the vertical rack 1001-A.

Figure 24:
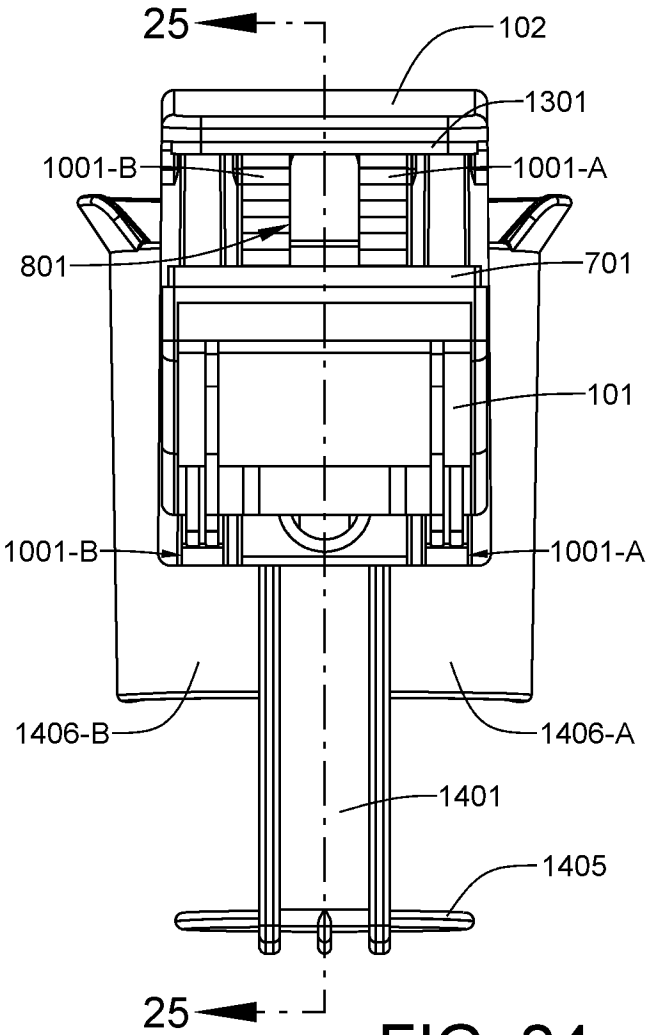
FIG. 24 is a rear elevational view of the bottle holder assembly.

Referring now to FIG. 24, the bottle holder assembly 100 is shown in a rear view. All three components of the bottle holder assembly 100 (the lower jaw 101, the upper jaw 102, and the bottle cage 103) are visible in this view. Upon attachment of the bottle cage 103 to the button 201 on the lower jaw 101, the upper jaw 102 and lower jaw 101 are immovably locked together.

Figure 25:
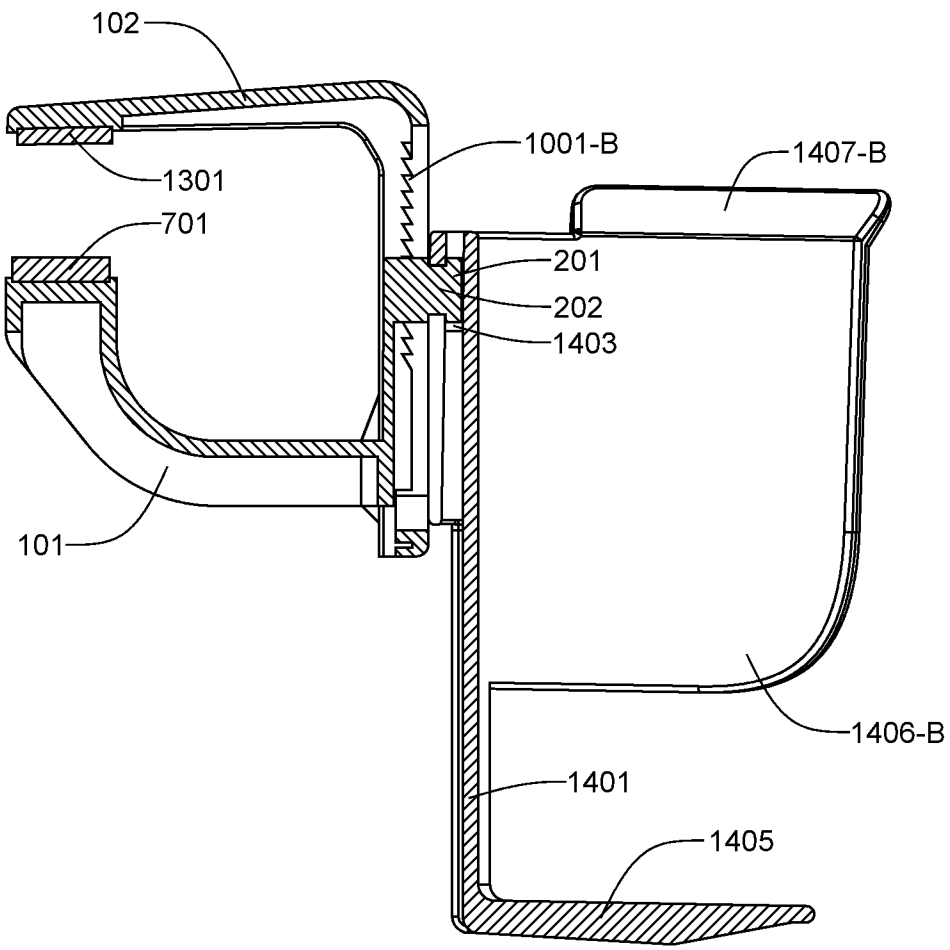
FIG. 25 is a cross-sectional view of the bottle holder assembly, taken through vertical center section plane 25-25 of FIG. 24.

Referring now to FIG. 25, this center cross-sectional view shows how the open-ended slot 1404 of connector 1402 fits over the stalk 202 and the button 201 and the speed bumps 1403 (only one is visible in this view) secure the bottle cage 103 to the lower jaw 102. In order to unlock the upper jaw 101 and the lower jaw 102, the best procedure is to squeeze the upper jaw 101 and lower jaw 102 together again to overcome the force loading of the locking teeth 204 against the teeth of the vertical rack 1001-A and 1001-B, and depress the button 101. While depressing the button 101, the upper and lower jaws, 102 and 101, respectively, can then be released. Thus, the button 201 functions as a lock release mechanism.

Figure 26:
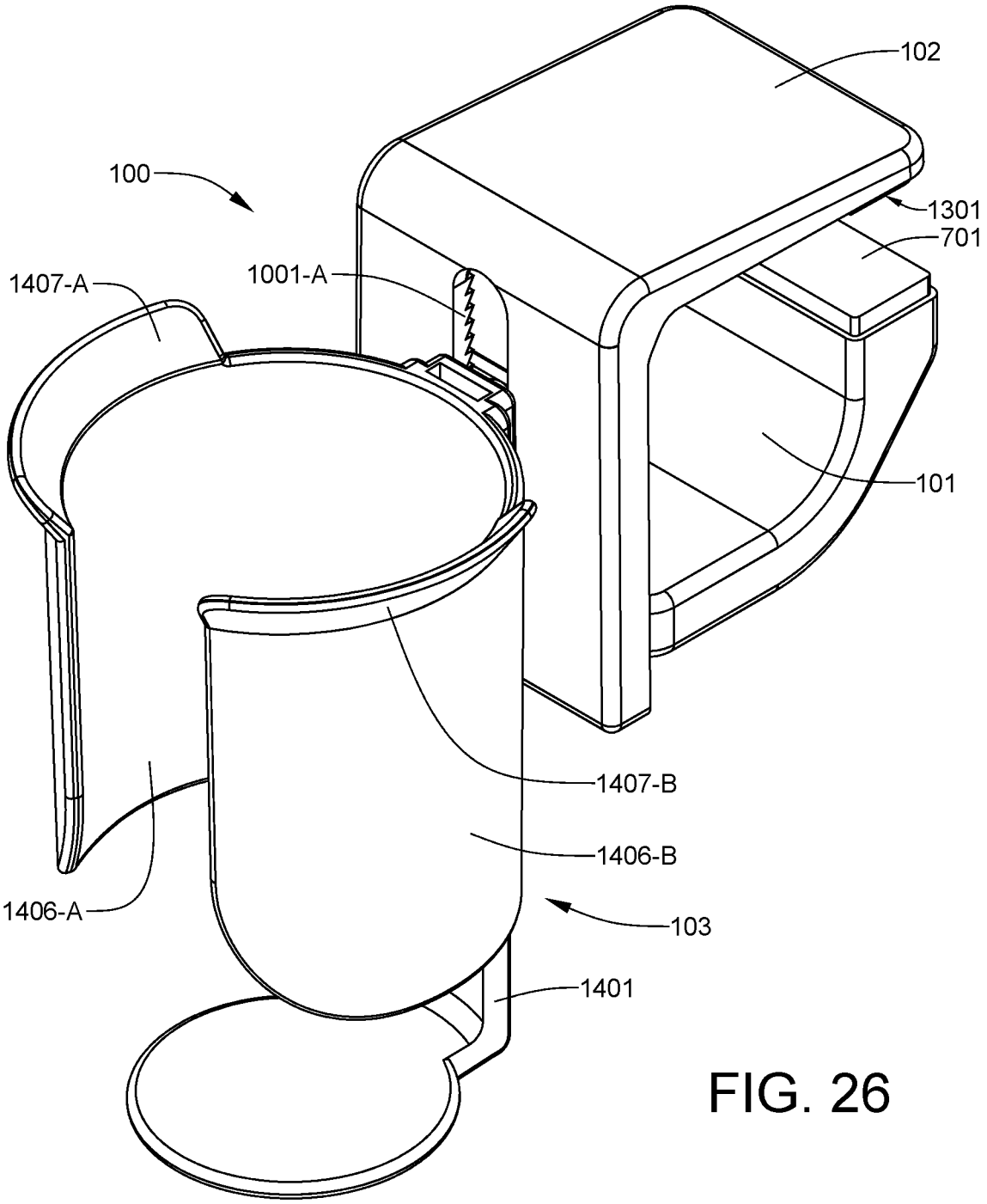
FIG. 26 is an isometric view of the bottle holder assembly, taken from an upper right front vantage point.

Referring now to FIG. 26, the bottle holder assembly 100 is shown with the bottle 104 removed. With the exception of the missing bottle 104, this is the same drawing as shown in FIG. 1.

Referring now to FIG. 27, this view shows the upper jaw 102 and the lower jaw 101 immovably locked together. With the pi-beam sliders 203-A and 203-B positioned within the vertical channels 1002-A and 1002-B, respectively, the lower jaw has been raised with respect to the upper jaw 101 until the locking teeth 204 on the resilient vertical panel 401 have engaged the teeth on the vertical racks 1001-A and 1001-B. Once the connector 1402 has been installed on the button 201 and the stalk 202, the locking function cannot be released by pressing the button 201.

Referring now to FIG. 28, the table top of a conventional domestic ironing board 2801 is shown clamped between the upper and lower jaws 102 and 101, respectively, of the bottle holder assembly 100. Pressure is exerted by resilient pads 1301 and 701 against the upper and lower surfaces of the ironing board table top 2801. The lower jaw has a horizontal front portion 2802 that is unitary with an upwardly projecting rear portion 2803 that provides clearance for the downwardly projecting perimetric rim 2804 of the ironing board 2801. A pad 2805 covers the ironing board 2801, and the pad is covered by a heat-resistant cover 2806. A draw string 2807 enables the cover to be secured to the ironing board 2801. A bottle 104 has been inserted within the bottle cage 103 of the bottle holder assembly 100. Functional details of the spray head 105 are not shown.

Although only a single embodiment of the bottle holder assembly 100 attachable to an ironing board has been shown and described, it will be obvious to those having ordinary skill in the art that changes and modifications may be made thereto without departing from the scope and the spirit of the invention as hereinafter claimed.

What is claimed is:

1. A bottle holder assembly comprising:

a first jaw equipped with a central, vertically-oriented slot, a rearward-facing rack with equally-spaced upwardly-ramped teeth on each side of said slot, and a channel with at least one overhanging edge adjacent each rack;

a second jaw equipped with a pair of spaced-apart sliders and a resilient upright panel to which are attached a forward-facing central button on a stalk and at least one forward-facing, downwardly-ramped locking tooth, wherein said second jaw mechanically engages the first jaw to form a slidable jaw assembly so that the two jaws can be squeezed together and immovably lock on a table top edge of an ironing board;

a bottle cage pivotally connectable to the jaw assembly, said bottle cage preventing release of a locked configuration of the jaws so long as it is connected to the jaw assembly; and wherein said first and second jaws are brought together so that the button and the stalk project through the slot, and each slider is aligned with a channel, and the jaws are subsequently squeezed together so that each slider enters a channel and said at least one locking tooth begins to ratchet against the racks until a desired gap between the jaws is achieved and the jaws are immovably locked together.

2. The bottle holder assembly of claim 1, wherein said at least one locking tooth engages teeth of the racks in a locking and ratcheting manner as the first and second jaws are squeezed together.

3. The bottle holder assembly of claim 2, wherein as the first and second jaws are squeezed together, each incremental ratcheting movement of the jaws results in the jaws being joined in a locked state, said locked state being releasable by disengaging said at least one locking tooth from the ramped teeth on said racks.

4. The bottle holder assembly of claim 1, wherein said bottle cage has a connector with an open-ended slot that slides over the stalk and prevents the button from being depressed in order to disengage said at least one locking tooth from the rack teeth, and thereby unlock the jaws.

5. The bottle holder assembly of claim 4, wherein:

the second jaw has a horizontal front portion unitary with an upwardly projecting rear portion, said upwardly projecting rear portion providing clearance for a downwardly projecting perimetric rim found on table tops of most ironing boards; and each jaw is equipped with a resilient pad that is adhesively bonded thereto, each resilient pad intended to be com pressed against a surface of the ironing board table top when the jaws are squeezed together.

6. A bottle holder assembly comprising:

an upper jaw equipped with a central, vertically-oriented slot, a rearward-facing rack with equally-spaced upwardly-ramped teeth on each side of said slot, and a channel with at least one overhanging edge adjacent each rack;

a lower jaw equipped with a pair of spaced-apart sliders, and a resilient upright panel to which are attached a forward-facing central button on a stalk and at least one forward-facing, downwardly-ramped locking tooth, wherein said lower jaw vertically and slidably engages the upper jaw to form a jaw assembly, said engaged jaw assembly forming a mouth that fits over a table top edge of an ironing board, wherein by squeezing the jaws together, a pressure is exerted by the jaws against an upper and a lower surface of the table top, and the jaws lock together to maintain the pressure against said upper and lower surfaces until a lock release mechanism is activated;

a bottle cage that connects to the jaw assembly and prevents activation of the lock release mechanism until the bottle cage is disconnected; and wherein said upper and lower jaws are brought together so that the button and the stalk project through the slot, and each slider is aligned with a channel, and the jaws are subsequently squeezed together so that each slider enters a channel and said at least one locking tooth begins to ratchet against the racks until a desired gap between the jaws is achieved and the jaws are immovably locked together.

7. The bottle holder assembly of claim 6, wherein said bottle cage has a connector with an open-ended slot that slides over the stalk and prevents the button from being depressed in order to unlock the jaws.

8. The bottle holder assembly of claim 7, wherein the connector is equipped with speed bumps that act as detents to retain the connector in a fully-installed position.

9. The bottle holder assembly of claim 6, wherein each jaw is equipped with a resilient pad that is adhesively bonded thereto, each resilient pad intended to be compressed against a surface of the ironing board table top when the jaws are squeezed together.

10. The bottle holder assembly of claim 9, wherein the lower jaw has a horizontal front portion unitary with an upwardly projecting rear portion, said upwardly projecting rear portion providing clearance for a downwardly projecting perimetric rim found on table tops of most ironing boards.

11. The bottle holder assembly of claim 6, wherein said at least one locking tooth engages teeth of the racks in a locking and ratcheting manner as the upper and lower jaws are squeezed together.

12. A bottle holder assembly comprising:

a first jaw equipped with a central, vertically-oriented slot, a rearward-facing rack with equally-spaced ramped teeth on each side of said slot, and a channel with at least one overhanging edge adjacent each rack;

a second jaw equipped with a pair of spaced-apart sliders, and a resilient upright panel to which are attached a forward-facing central button on a stalk and at least one forward-facing, locking tooth that is ramped in a direction opposite the direction in which the rack teeth are ramped, and ramped away from the first jaw, said first and second jaws being brought together so that the button and the stalk project through the slot, and each slider is aligned with a channel, and the jaws are subsequently squeezed together so that each slider enters a channel to form a jaw assembly having a mouth that fits over a table top edge of an ironing board, and wherein by further squeezing said first and second jaws together, said at least one locking tooth begins to ratchet against the racks until a desired gap between the jaws is achieved and the jaws are immovably locked together against upper and lower surfaces of the table top until the button is depressed to release said at least one locking tooth from the rack teeth; and a bottle cage having a connector with an open-ended slot that fits over the stalk and prevents the button from being depressed.

13. The bottle holder assembly of claim 12, wherein the connector is equipped with speed bumps that act as detents to retain the connector in a fully-installed position.

14. The bottle holder assembly of claim 12, wherein each jaw is equipped with a resilient pad that is adhesively bonded thereto, each resilient pad intended to be compressed against a surface of the ironing board table top when the jaws are squeezed together.

15. The bottle holder assembly of claim 12, wherein one of the jaws has a horizontal front portion unitary with an upwardly projecting rear portion, said upwardly projecting rear portion providing clearance for a downwardly projecting perimetric rim found on table tops of most ironing boards.

16. The bottle holder assembly of claim 12, wherein said first jaw is an upper jaw, and said second jaw is a lower jaw.

17. The bottle holder assembly of claim 16, wherein by making the first jaw the upper jaw and the second jaw the lower jaw, appearance of the assembly is enhanced because the channels and entrances thereto are positioned below the table top of the ironing board and generally not visible to a user.

18. The bottle holder of claim 12, wherein the bottle cage has a flared upper opening to facilitate introduction of a bottle into the bottle cage.

* * * * *